US008320596B2

(12) United States Patent
Ishibashi et al.

(10) Patent No.: US 8,320,596 B2
(45) Date of Patent: Nov. 27, 2012

(54) ARRAY SPEAKER SYSTEM AND ARRAY MICROPHONE SYSTEM

(75) Inventors: Toshiaki Ishibashi, Fukuroi (JP); Takuya Tamaru, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 1261 days.

(21) Appl. No.: 11/988,625

(22) PCT Filed: Mar. 28, 2006

(86) PCT No.: PCT/JP2006/306214

§ 371 (c)(1),
(2), (4) Date: Jan. 11, 2008

(87) PCT Pub. No.: WO2007/007446

PCT Pub. Date: Jan. 18, 2007

(65) Prior Publication Data

US 2010/0220877 A1 Sep. 2, 2010

(30) Foreign Application Priority Data

Jul. 14, 2005 (JP) ..... 2005-205923
Jul. 19, 2005 (JP) ..... 2005-208321

(51) Int. Cl.
*H04R 1/02* (2006.01)

(52) U.S. Cl. ..... 381/335; 381/182; 381/91

(58) Field of Classification Search ..... 381/92, 381/59, 335, 182, 152, 361, 386, 87, 91; 340/4.41

See application file for complete search history.

(56) References Cited

U.S. PATENT DOCUMENTS 4,521,908 A 6/1985 Miyaji et al.

(Continued)

FOREIGN PATENT DOCUMENTS

JP A-59-041995 3/1984

(Continued)

OTHER PUBLICATIONS

Japan Patent Office "Notice of Reasons for Rejection", Japanese Patent Application No. 2005-205923, Drafting Date May 26, 2010, 3 pages.

(Continued)

*Primary Examiner* — Xu Mei
*Assistant Examiner* — Andrew Graham
(74) *Attorney, Agent, or Firm* — Pillsbury Winthrop Shaw Pittman LLP

(57) ABSTRACT

A plurality of speakers are linked in the present invention. The linked position of each speaker can be detected. Audio signal is input to any one of the master speakers. The master speaker synchronizes the other linked speakers, and supplies audio signals to other speakers. It also controls the delay quantity of the speaker unit of each speaker. For a single speaker, the apparent width of this array speaker system becomes twice the width, and the speaker unit spacing becomes one third the spacing. Consequently, the frequency band at which direction is controllable becomes enhanced.

Additionally, a plurality of microphone devices are linked at the top, bottom, left and right sides in the present invention. The linked position of each microphone device can be detected. Audio data is output from each microphone device to the master microphone device. The master microphone device synchronizes with other linked microphone devices, treats them as array microphones in the entire linked array microphone system, and controls the delay quantity of the microphone unit of the microphone device. For a single microphone device, the apparent width of this array microphone system becomes twice the width, and the microphone unit spacing becomes one-third the spacing. Consequently, the frequency band at which direction is controllable becomes enhanced.

4 Claims, 10 Drawing Sheets

U.S. PATENT DOCUMENTS

| | | | | |
|---|---|---|---|---|
| 5,233,664 | A | 8/1993 | Yanagawa et al. | |
| 5,406,634 | A * | 4/1995 | Anderson et al. | 381/82 |
| 5,946,401 | A * | 8/1999 | Ferren | 381/82 |
| 6,801,631 | B1 * | 10/2004 | North | 381/336 |
| 6,807,281 | B1 | 10/2004 | Sasaki et al. | |
| 7,062,064 | B2 * | 6/2006 | Bachmann et al. | 381/431 |
| 7,260,235 | B1 * | 8/2007 | Henricksen et al. | 381/335 |
| 7,646,876 | B2 * | 1/2010 | Chu et al. | 381/92 |
| 2003/0185404 | A1 * | 10/2003 | Milsap | 381/77 |
| 2004/0151325 | A1 * | 8/2004 | Hooley et al. | 381/18 |
| 2004/0264716 | A1 * | 12/2004 | Fidlin et al. | 381/161 |
| 2005/0201583 | A1 * | 9/2005 | Colich | 381/335 |
| 2006/0072765 | A1 * | 4/2006 | Shibutani | 381/59 |
| 2006/0104457 | A1 * | 5/2006 | Kawaguchi et al. | 381/91 |
| 2006/0115101 | A1 * | 6/2006 | Schoenberger | 381/120 |
| 2006/0126878 | A1 * | 6/2006 | Takumai et al. | 381/335 |
| 2006/0204022 | A1 * | 9/2006 | Hooley et al. | 381/117 |
| 2006/0210093 | A1 * | 9/2006 | Ishibashi et al. | 381/80 |
| 2007/0229215 | A1 * | 10/2007 | Jha | 340/3.1 |
| 2010/0177909 | A1 * | 7/2010 | Aarts et al. | 381/92 |

FOREIGN PATENT DOCUMENTS

| | | | |
|---|---|---|---|
| JP | A-05-041897 | | 2/1993 |
| JP | A-05-091588 | | 4/1993 |
| JP | A-11-262084 | | 9/1999 |
| JP | A-2004-032314 | | 1/2004 |
| JP | 2005-64746 | A | 10/2005 |
| WO | WO 03079486 | A1 * | 9/2003 |
| WO | WO 2004/075601 | A1 | 9/2004 |
| WO | WO 2007/007083 | A1 | 1/2007 |

OTHER PUBLICATIONS

Japan Patent Office "Notice of Reasons for Rejection", Japanese Patent Application No. 2005-208321, Drafting Date May 26, 2010, 2 pages.

European Patent Office "Extended European Search Report" dated Jul. 28, 2011, Application No. 06730162.2 of Yamaha Corporation, 8 pages.

* cited by examiner

ARRAY SPEAKER SYSTEM AND ARRAY MICROPHONE SYSTEM

This application is the National Phase of International Application PCT/JP2006/306214, filed Mar. 28, 2006 which designated the U.S. and that International Application was not published under PCT Article 21(2) in English.

TECHNICAL FIELD

The present invention relates to direction controllable array speaker system, particularly to array speaker system with enhanced direction controllable frequency band. Additionally, the present invention relates to direction controllable array microphone system, particularly to array microphone system with enhanced direction controllable frequency band.

Priority is claimed on Japanese Patent Application No. 2005-205923, filed Jul. 14, 2005, and the Japanese Patent Application No. 2005-208321, filed Jul. 19, 2005, both filed with the Japanese Patent Office, the contents of which are incorporated herein by reference.

BACKGROUND ART

In recent years, home theaters where one can enjoy a highly realistic feeling of a movie theater within the home, are becoming popular. A home theater with multiple speakers installed to surround the listener as represented by a 5.1-channel surround is common. A surround system realized by multiple speakers in this way, however, required complex wiring systems to each speaker, and also had the problem that space was required to install multiple speakers.

Audio playback systems are being proposed (for example, refer to the Japanese Unexamined Patent Application, First Publication No. 2005-64746) using a speaker array with a plurality of speaker units disposed in lines that create virtual sound sources surrounding the listener making use of reflections of the audio beam of the speaker array from the wall faces of a room.

FIG. 7 shows the construction of the line array speaker in the audio playback system described in the Japanese Unexamined Patent Application, First Publication No. 2005-64746. This line array speaker is composed of a plurality of speaker units 21 (21-1 to **21-*n*) in slender cases disposed side by side on a line. Each speaker unit 21** is disposed at equal intervals with a spacing d; the width of the speaker array is L.

If an audio signal of the same phase is input to a plurality of speaker units 21, the synthesized wavefront of audio output from all the speaker units 21 become parallel audio beams that propagate only toward the front. Audio components that propagate in directions other than the front are canceled out (by mutual interference) when the components output from each speaker unit 21 are synthesized, and only the components directed toward the front are reinforced by synthesis and remain as audio beams. When audio output from the speaker unit 21 is sequentially delayed from one end to the other end, the synthesized wavefront inclines according to this delay time so that the audio beam can be directed in an inclined direction.

In this way, by controlling the delay quantity of the audio signals input to a plurality of speaker units, the audio beam can be directed in the target direction (directional characteristics can be controlled).

If the speaker array width L is increased (the number of speaker units increased) in the line array speaker shown in FIG. 7, the directional characteristics become sharper, and the audio beam can be concentrated in the target direction. Moreover, if the speaker array width is increased, direction control is possible even on the low frequency band side.

The beam width of the audio beam is determined by formula 1 given below (wherein v is the velocity of sound, f is the frequency).

$$\theta=\sin^{-1}(v/fdn) \qquad \text{Formula 1}$$

To increase the speaker array width, the number of speaker units may be increased; alternatively, to increase the speaker array width with the same number of speaker units, the spacing d may be increased. If the speaker unit spacing d is increased, however, the problem of audio beam generated in a direction other than the target direction may occur because of the spatial alias, so direction control in the high frequency band becomes difficult. To ensure that a different audio beam is not generated, d should be set such that the conditions in the formula 2 below are satisfied.

$$d<v/2f \qquad \text{Formula 2}$$

For example, when the spacing d of the speaker units is 4.5 cm (d=4.5 cm), width L of the speaker array is 67.5 cm (L=67.5 cm), then from Formula 1, the low frequency side of the frequency band at which direction is controllable is about 500 Hz, and from Formula 2, the high frequency side becomes 4 kHz approximately. Accordingly, the frequency band at which direction was controllable was 500 Hz approximately to 4 kHz approximately. Playback of bandwidth used for telephone voice was possible, but playback of bandwidth required for home theaters (for example, 250 Hz to 12 kHz approximately) could not be realized. To realize this, the number of speaker units needs to be increased, but the problem that arises is that cost increases when the number of speaker units increases.

In this way, a trade-off relationship exists between the improvement in direction controllable frequency and the suppression of cost.

Consequently, an array speaker system that enables arbitrary design of direction controllable frequency band according to the required frequency band is demanded.

In teleconferences and the like, the narrator's voice is required to be picked up correctly by the microphone. For this reason, a directional microphone is used and sound in the direction of the narrator is efficiently picked up.

Additionally, a pickup apparatus for directivity control has been proposed (for example, refer to Japanese Unexamined Patent Application, First Publication No. 1993-91588) using an array microphone (line) composed of a plurality of microphone units, and setting the delay time in the output of each microphone unit.

FIG. 14 shows the construction of a line array microphone. This line array microphone is composed of a plurality of microphone units 221 (221-1 to **221-*n*) in slender cases disposed side by side on a line. Each microphone unit 221** is disposed at equal intervals at a spacing $d_2$, and the width of the array microphone is $L_2$.

Plane sound waves (sound waves at the same phase) that reach a plurality of microphone units 221 normally from the front side are picked up by each microphone unit 221. When the audio signals output by each of the microphone units 221 are synthesized, they are reinforced because they are in the same phase. On the other hand, sound waves that arrive from a direction other than the front side (for example, from the side of the line array microphone), differ in phase from the audio signals output by each of the microphone units 221; thus, when synthesized, they cancel out each other. Accordingly, the sensitivity of the array microphone is reduced in beam form, and the main sensitivity (main beam) is formed only in the front direction.

Here, if the audio signal from each microphone unit 221 is sequentially delayed from one end to the other end, the pickup direction at which the maximum level occurs inclines according to the delay time, and the main beam can be directed in an inclined direction.

In this way, by controlling the delay quantity in the audio signal output from a plurality of microphone units, sound can be picked up from the target direction (directional characteristics can be controlled).

If the width $L_2$ of the array microphone is increased (the number of microphone units increased) in the line array microphone as shown in FIG. 14, the directional characteristics become sharper, and the main beam can be concentrated in the target direction. Additionally, if the width $L_2$ of the array microphone is increased, direction control is possible on the side of lower frequency bands.

The beam width of the main beam is determined by Formula 3 given below (wherein v is the velocity of sound, f is the frequency).

$$\theta=\sin^{-1}(v/fd_2n) \qquad \text{Formula 3}$$

To increase the width L of the microphone array, the number of microphone units may be increased, or the microphone unit spacing $d_2$ may be increased keeping the number of units the same. If the microphone unit spacing $d_2$ is increased, however, the problem that may occur is that the main beam is generated in a direction other than the desired direction because of the spatial alias, so direction control in the high frequency band becomes difficult. To ensure that a different main beam is not generated, $d_2$ should be set such that the conditions in the Formula 4 below are satisfied.

$$d_2<v/2f \qquad \text{Formula 4}$$

For example, if the microphone unit spacing $d_2$=4.5 cm, and the microphone array width $L_2$=67.5 cm, the low frequency side of the frequency band at which direction is controllable in the range of beam widths 3 dB below the peak value becomes 500 Hz approximately according to Formula 3 to arrive at a value of θ±30°, and becomes approximately 4 kHz on the high frequency side according to Formula 4. Thus, the frequency band at which direction is controllable became approximately 500 Hz to approximately 4 kHz, and the bandwidth pickup of telephone voice approximately was realized; however, bandwidth pickup (for example, 250 Hz to 12 kHz approximately) required for music recording applications could not be realized. To realize this, the number of microphone units needs to be increased, but the problem that arises is that the cost increases when the number of microphone units increases.

In this way, a trade-off relationship exists between the improvement in frequency at which direction control is possible and the suppression of cost.

Consequently, an array microphone system that enables arbitrary design of direction controllable frequency band according to the required frequency band is demanded.

DISCLOSURE OF INVENTION

The array speaker system of the present invention includes a plurality of line array units each including a plurality of speaker units aligned on a straight line. The line array units are linked in the vertical direction normal to the straight line, or linked in the left-right direction in the direction of the straight line.

The line array unit in the present invention is linked at the top, bottom, left and right sides. For example, if two speaker arrays are placed side by side on the left and right sides, the apparent speaker array width L becomes twice the width, and the lower limit of frequency at which direction is controllable, becomes broadened twice as much.

Furthermore, according to the present invention, the plurality of line array units disposed in the vertical direction are offset in the left-right direction by "the spacing/number of steps in array of the speaker units" and linked.

In the present invention, when n line array units are overlapped in the vertical direction, the speaker units are overlapped by an offset of only 1/n times the spacing. When the speaker units are overlapped by an offset of only 1/n times the spacing, the apparent spacing d of the speakers becomes 1/n times the spacing, and the upper limit of frequency at which direction control is possible becomes n times the frequency.

Moreover, according to the present invention, a plurality of line array units are linked in the left-right direction, and other line array units are linked at the top and the bottom at the center of the arrangement in the left-right direction.

According to the present invention, the line array units are placed side by side in the left-right direction and linked to each other, and other line array units are overlapped at their center. Since the direction controllable band on the side of low frequency is enhanced if the speaker array width is increased, but is not effected by the spacing of the speaker units, there is no need to link different line array units at the top and bottom on the left and right sides of the line array unit.

The line array unit of the present invention is provided with a plurality of speaker units disposed side by side on straight lines, an input device for inputting audio signals, a signal processing device for supplying the audio signals by delaying them at specific delay times to each speaker unit and for controlling the directivity of the line array unit, a link detection device for detecting the mode of the link and its position therein, and a control device for setting the delay quantity of the signal processing device according to the linked mode and the linked position detected by the link detection device.

According to the present invention, the linked mode and the position therein are detected, and the delay quantity of each speaker unit is set according to its position. As a result, the directional characteristics of the entire array speaker system can be controlled. The delay quantity of each control device may be set independently, or the delay quantity of the entire array speaker system may be set by the control device of any one of the linked line array units.

According to the present invention, a plurality of line array units is linked, and the apparent speaker array width and the speaker unit width can be changed, so the frequency band at which direction control is possible can be designed arbitrarily according to the frequency band required.

The array microphone system of the present invention is provided with a plurality of line array units each including a plurality of microphone units disposed side by side on straight lines, with the plurality of line array units linked in the vertical direction, which is normal to the straight lines, or linked in the left-right direction, which is in the direction of the straight lines.

The line array unit in the present invention is linked at the top, bottom, left and right sides. For instance, if two array microphones are disposed side by side in the left-right direction, the apparent array microphone width L becomes twice the width, and the lower limit of frequency at which direction control is possible, becomes broadened twice as much.

Furthermore, according to the present invention, the plurality of line array units disposed in the vertical direction are offset in the left-right direction by "the spacing/number of steps in array of the microphone units" and linked.

In the present invention, when n line array units are overlapped in the vertical direction, the microphone units are overlapped after offsetting them by only 1/n times the spacing. When the microphone units are overlapped after offsetting them by only 1/n times the spacing, the apparent microphone spacing $d_2$ becomes 1/n times the spacing, and the upper limit of the frequency at which direction control is possible becomes n times the frequency.

Moreover, according to the present invention, a plurality of line array units are linked in the left-right direction, and other line array units are linked at the top and the bottom at the center of the arrangement in the left-right direction.

According to the present invention, the line array units are placed side by side in the left-right direction and linked to each other, and other line array units are overlapped at their center. Since the direction controllable band on the low frequency side is enhanced when the array microphone width is increased by a large amount, but is not effected by the microphone unit spacing, there is no need to link to line array units above and below on the side of the left and right ends of the line array unit.

The line array unit of the present invention is provided with a plurality of microphone units disposed side by side on straight lines; a signal processing device for delaying the delay time of audio signals output by each microphone unit and for controlling the directivity of line array units in each microphone unit; an output device for outputting audio signals externally; a link detection device for detecting the linked mode and its position therein; and a control device for setting the delay quantity of the signal processing device according to the linked mode detected by the link detection device and the linked position.

In the present invention, the linked mode and the position therein are detected, and the delay quantity of each microphone unit is set according to its position. As a result, the directional characteristics of the entire array microphone system can be controlled. The delay quantity of each control device may be set independently, or the delay quantity of the entire array microphone system may be set by the control device of any one of the linked line array units.

According to the present invention, a plurality of line array units can be linked and the apparent array microphone width and microphone unit spacing can be changed, so that direction controllable frequency band can be arbitrarily designed according to the required frequency band.

BEST MODE FOR CARRYING OUT THE INVENTION

Figure 1:
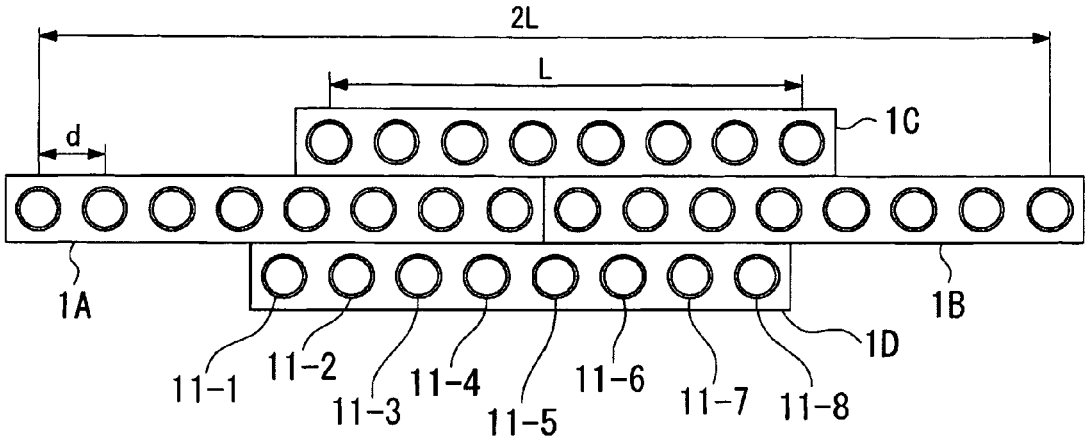
FIG. 1 is a schematic view showing the configuration of an array speaker system.

FIG. 1 is a schematic view showing the configuration of an array speaker system related to the embodiments of the present invention. As shown in this figure, this array speaker system is provided with a plurality of speakers 1A to 1D.

Speaker 1A and speaker 1B are aligned and linked in the left-right direction. Speaker 1C is linked to the upper part of speaker 1A and speaker 1B; speaker 1D is linked to the lower part of speaker 1A and speaker 1B.

Each speaker 1 is configured with 8 speaker units 11-1 to 11-8 disposed in a line at spacing d, and is equivalent to the line array unit of the present invention. The speaker unit used is generally a cone-shaped speaker unit, but other shapes, such as horn-shaped speaker units may also be used. The distance between one end of the speaker unit 11-1 and the other end of the speaker unit 11-8 is L. This distance L is taken as the width L of the speaker 1. The array speaker system of the present embodiment has the speaker 1A and the speaker 1B aligned in the left-right direction and linked to each other, so the apparent width of this array speaker system is 2 L. In this example, a speaker disposed with 8 speaker units is shown, but more speaker units may be disposed or lesser speaker units may be disposed.

The speaker 1C is connected to the upper part of speaker 1A and the speaker 1B at the center such that the position of this speaker in the horizontal direction is offset by d/3 to the right side. The speaker 1D is connected to the lower part of speaker 1A and the speaker 1B at the center such that the position of this speaker in the horizontal direction is offset by d/3 to the left side.

Figure 2:
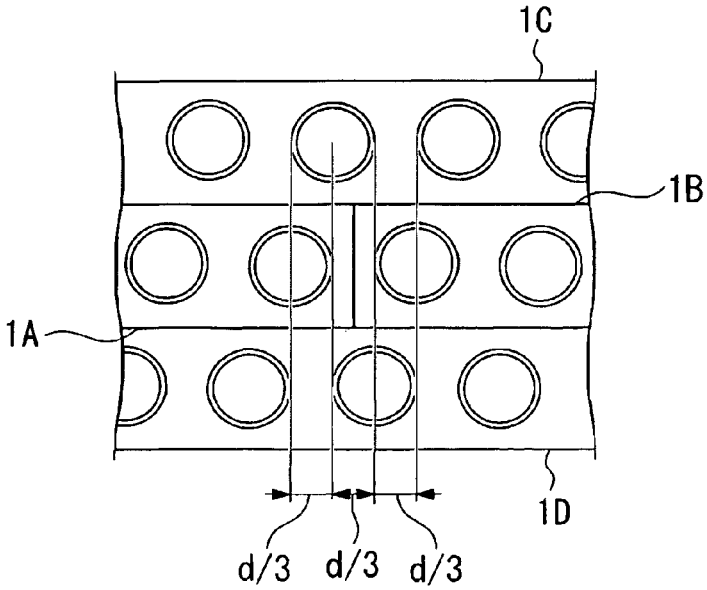
FIG. 2 is an explanatory diagram related to the overlapping of speakers.

FIG. 2 is an explanatory diagram related to the overlap of speakers. As shown in this figure, the speaker 1C overlaps the upper part of the speaker 1A and the speaker 1B and is offset by a distance of only d/3 to the right side. Similarly, the speaker 1D overlaps the lower part of the speaker 1A (and the speaker 1B) and is offset by a distance of only d/3 to the left side. Accordingly, the apparent spacing of the speaker units of the array speaker system at these overlapped locations becomes d/3.

Figure 3A:
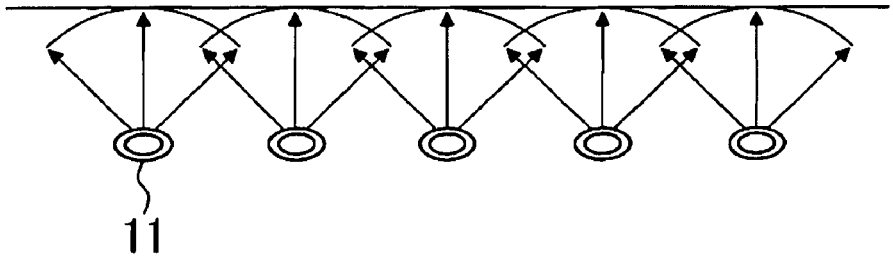
FIG. 3A is an explanatory diagram illustrating the principle of speaker array when audio signals of the same phase are input at the same time to the speaker units.
Figure 3B:
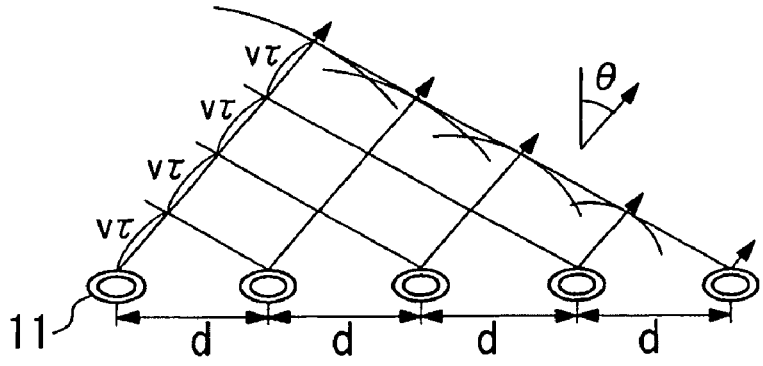
FIG. 3B is an explanatory diagram illustrating the principle of speaker array when an inclined audio beam is formed.

FIG. 3A and FIG. 3B are explanatory diagrams illustrating the principle of speaker arrays. The principle of speaker arrays is described here.

FIG. 3A shows audio signals of the same phase input at the same time to all the speaker units 11. When audio signals of the same phase are input at the same time to all the speaker units 11, the audio output from individual speaker units will be propagated in radial form (circular), but the synthesized wavefront of audio output from all the speaker units 11, will be reduced to beam form and propagated toward the front, as shown in the figure. Audio components that propagate in directions other than the front are canceled out (by mutual interference) when the components output from each speaker unit 11 are synthesized, and only the components directed toward the front are reinforced by synthesis and remain as audio beams.

FIG. 3B shows audio beams formed in an inclined condition. In the same figure, the audio beams are formed at an angle θ to the right of the frontal view. In this case, audio is output first from the speaker unit 11 at the end (left end) of the side opposite to the direction of the audio beam. Next, audio is output sequentially from each adjacent speaker unit 11 on the right side when a time τ has elapsed. This delay time is controlled by the direction control unit (described later) connected to each speaker unit 11. In this way, when audio output from the speaker units 11 aligned up in a row is sequentially delayed from one end to the other end, the synthesized wavefront can be inclined according to this delay time as illustrated, so that the audio beam can be directed in an inclined direction.

This inclination angle θ, considering the sound velocity as v, is given by $\theta=\sin^{-1}(v\tau/d)$. Accordingly, the angle θ of the audio beam can be controlled by controlling τ.

FIG. 4A to FIG. 4D are figures that show examples of control angle of the audio beam.

Figure 4A:
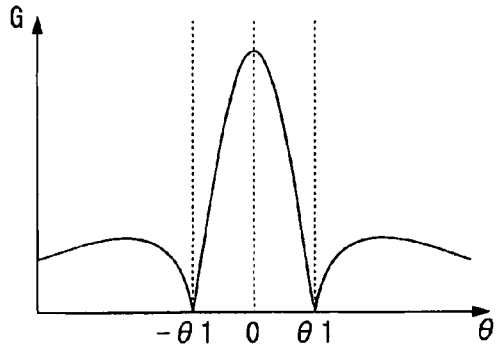
FIG. 4A is a figure showing an example of control angle of an audio beam.

FIG. 4A shows the relationship between the angle θ and the gain G for an example in which the number of speaker units n=16, the spacing of speaker units d=4.5 cm, and the width of the speaker array L=67.5 cm. The horizontal axis represents θ and the vertical axis represents the gain (taken as G) of the speaker array in the graph shown in FIG. 4A.

In FIG. 4A, the gain G becomes maximum at θ=0 when the target audio beam direction is taken as θ=0. Upon moving away from θ=0, the gain G decreases because of interference of sound output from each speaker unit, and θ becomes zero at θ=±θ1. The width until the gain G becomes zero across the target audio beam direction θ=0 is taken as the beam width. The θ1 at which this gain becomes zero, that is, the audio beam width from the formula 1 above taking the frequency as f is determined as $\theta 1=\sin^{-1}(v/fdn)$.

FIG. 4A shows an example related to frequency f=1 kHz. Here, each of the speaker units in the preset embodiment is disposed at equal intervals at a spacing d. The width of the speaker array L is expressed by L=d(n−1), and the beam width θ1 is determined from Formula 1 from the speaker unit spacing d, the speaker array width L and the frequency f.

Figure 4B:
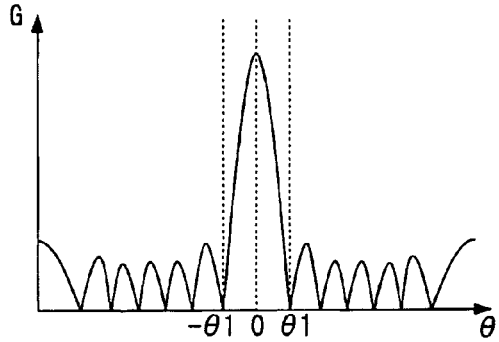
FIG. 4B shows an example of the control angle of an audio beam when the number of speaker units with the conditions of FIG. 4A is taken as four times.

FIG. 4B shows the relationship between angle θ and gain G when the number of speaker units n is multiplied by 4 and taken as n=64 in the conditions of FIG. 4A. The horizontal axis is θ and the vertical axis is gain in the graph shown in FIG. 4B also. The beam width in FIG. 4B is smaller than the beam width shown in FIG. 4A, and has sharp directional characteristics in the target direction. Moreover from the relationship sin θ1=v/fdn, even if the frequency f is multiplied by 4 and the speaker unit width d is multiplied by 4, the beam width as shown in FIG. 4B can be obtained.

Figure 4C:
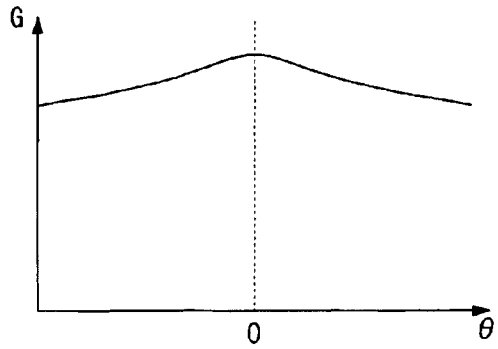
FIG. 4C shows an example of the control angle of an audio beam when the frequency with the conditions of FIG. 4A is taken as one-fourth the frequency.

FIG. 4C shows the relationship between the angle θ and gain G when one fourth the frequency f is taken, that is when f=250 Hz in the conditions in FIG. 4A. Even in the graph shown in FIG. 4C, the horizontal axis represents θ and the vertical axis represents gain. In FIG. 4C, θ1 at which the gain G becomes zero, does not exist.

Figure 4D:
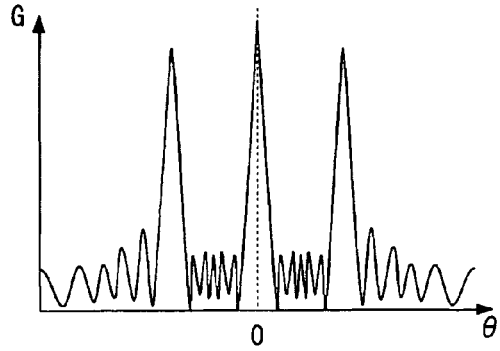
FIG. 4D shows an example of the control angle of audio beam when the frequency with the conditions of FIG. 4A has been made eight times the frequency.

FIG. 4D shows the relationship between the angle θ and gain G when 8 times the frequency f is taken, that is when f=8 kHz in the conditions in FIG. 4A. Even in the graph shown in FIG. 4D, the horizontal axis represents θ and the vertical axis represents gain. The audio beam occurs even in directions other than θ=0 in FIG. 4D. This is the so-called the spatial alias, and the phenomenon shown in FIG. 4D occurs at frequencies where d≦v/2f.

In this way, the speaker array has frequency dependence on the audio beam width, and as in the example above, when the number of speaker units n=16, the speaker unit spacing d=4.5 cm, and the speaker array width L=67.5 cm, the frequency band at which direction is controllable is approximately 500 Hz to 4 kHz. At frequencies lower than the frequency band, the directional characteristics do not exist as shown in FIG. 4C; at high frequencies, the audio beam occurs even in directions other than the target direction, as shown in FIG. 4D.

As mentioned above, θ1 at which the gain G becomes zero is expressed by sin θ1=v/fdn. Thus, the effect of the speaker unit spacing d and the number of speaker units n on θ1 is the same. That is, by reducing the speaker unit spacing d, and by increasing the speaker array width L by increasing the number of speaker units n, the direction controllable frequency bandwidth can be expanded.

Here, the array speaker system of the present embodiment has the speaker 1A and the speaker 1B aligned in the left-right direction and linked to each other, so the apparent number of speaker units n of this array speaker system is two times; that is, the width L of this speaker array is doubled, and the frequency band at which direction is controllable expands and becomes double on the low frequency side. Additionally, the speaker 1C and the speaker 1D are overlapped and offset above and below by only d/3 in the left-right direction; therefore, the apparent spacing of the speaker units of this array speaker system becomes d/3, and the frequency band at which direction is controllable expands to three times on the high frequency side.

Accordingly, by decreasing the number of speaker units in the array speaker system of the present invention, designing standalone speakers with reduced cost, and by linking a plurality of speakers as in the examples described above according to the required frequency band, the direction controllable frequency band can be easily enhanced.

Next, details of the configuration of each speaker in the array speaker system of the present embodiment are described.

Figure 5:
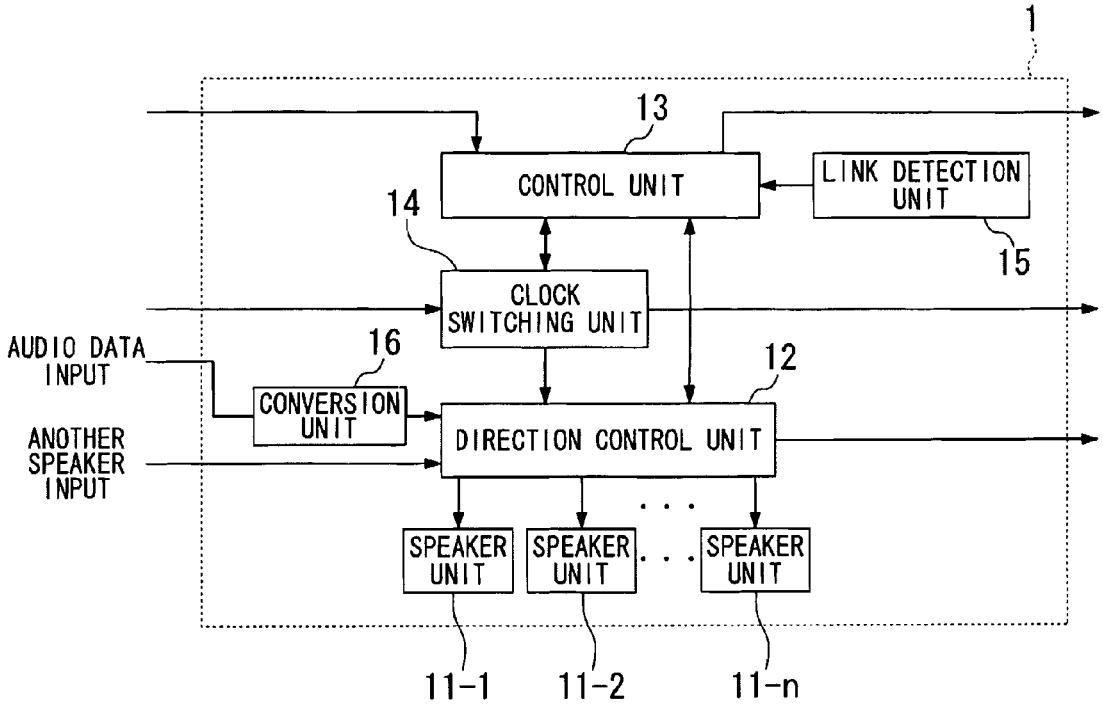
FIG. 5 is a block diagram showing the configuration of a speaker.

FIG. 5 is a block diagram showing the configuration of a speaker. As shown in this figure, the speaker 1 includes n speaker units 11-1 to **11-*n*, a direction control unit 12, a control unit 13, a clock switching unit 14, a link detection unit 15, and a conversion unit 16**.

The n speaker units 11-1 to **11-*n*, are connected to the direction control unit 12; the direction control unit 12 is connected to the control unit 13, the clock switching unit 14, and the conversion unit 16. The link detection unit 15 is connected to the control unit 13**.

The direction control unit 12, the control unit 13, and the clock switching unit 14, are each connected to the direction control unit 12, the control unit 13 and the clock switching unit 14 respectively of a different speaker 1. The direction control unit 12, the control unit 13, and the clock switching unit 14 may be connected to another speaker 1 by a shared connecting wire (connection terminal), or each may be connected individually through a dedicated connecting wire (connection terminal).

The direction control unit 12 feeds a specific delay quantity in the input audio data to each of the speaker units 11-1 to **11-*n*, and controls the directivity of the speaker array. Each delay quantity is set by the control unit 13. The speaker units 11-1 to 11-*n*** perform D/A conversion of each audio data input and radiate sound.

The control unit 13 controls the clock switching unit 14 and the direction control unit 12, sends control commands to the control unit 13 of other connected speakers 1 and controls the other control units 13.

The clock switching unit 14 is connected to a crystal oscillator (not illustrated) built-in within the speaker, and feeds reference clock to the direction control unit 12. The direction control unit 12 operates based on this reference clock. Moreover, when the clock switching unit 14 is connected to the clock switching unit 14 of another speaker, it sends the reference clock to the clock switching unit 14 of the other speaker. When the reference clock is received from another speaker 1, either the reference clock received by the direction control unit 12, or the reference clock of the built-in crystal oscillator is selectively supplied.

The conversion unit 16 is provided with an A/D conversion function for digital conversion of analog audio signals input from audio equipment, and a frequency conversion function for converting sampling frequency (for example 44.1 kHz) of audio data when digital audio data has been input to standard frequency (for example, 48 kHz) of this speaker 1. The converted audio data is supplied to the direction control unit 12.

The direction control unit 12 supplies a specific delay quantity in the audio data input from the conversion unit 16 to each of the speaker units 11-1 to **11-*n*, based on the instructions of the control unit 13**.

Figure 6:
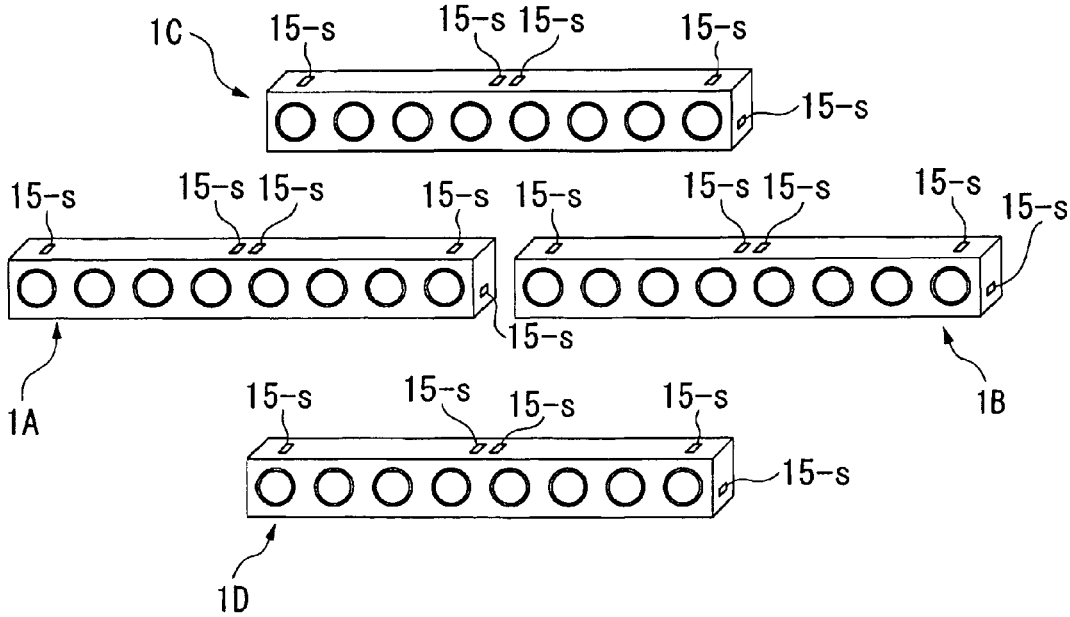
FIG. 6 is a conceptual diagram showing the linking connectors.
Figure 7:
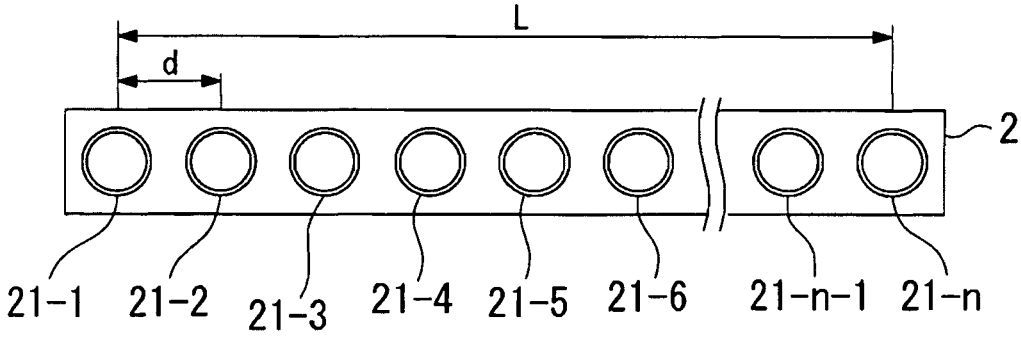
FIG. 7 is a block diagram showing a conventional line array speaker unit.

FIG. 6 shows the link detection unit 15 composed of multiple linking connectors **15-*s* installed around the speaker 1. This link detection unit 15 detects the connection state of each speaker 1, and transmits whether its own speaker 1 is connected at a position within the array speaker system to the control unit 13. Each speaker 1 is installed with a linking connector 15-*s* on the right side face, left side face, right upper face, right central upper face, left central upper face, left upper face, right lower face, right central lower face, left central lower face, and left lower face respectively. The connected position can be detected according to which linking connector 15-*s* is connected to the linking connector 15-*s* of the other speaker 1**.

For example, in the same figure, the speaker 1A is connected at the right side face connector, right upper face connector, right central upper face connector, right lower face connector, and right central lower face connector. With such a connection arrangement, the link detection unit 15 is judged to be positioned on the left side of the central stage of this speaker 1 in the array speaker system. By this, the linked position within the array speaker system can be detected.

As mentioned above, these linking connectors **15-*s* are installed at linking positions where the speaker unit 11 is displaced by d/3 in the vertical direction. The direction control unit 12, the control unit 13, and the clock switching unit 14 mentioned above, are connected to another direction control unit 12, control unit 13, and clock switching unit 14 by this linking connector 15-*s***.

The method of detecting this linking position is not limited to the present example. For instance, the position of the speaker 1 may be specified by user's manual operation.

Next, details of direction control of this array speaker system are described. When the user connects audio equipment to a speaker 1 and inputs the audio signal, this speaker 1 becomes the master speaker of the array speaker system. This master speaker controls the other linked speaker 1. Either the speaker 1 to which audio signal from the audio equipment is input may be used as the master speaker, or the other speaker 1 may be used as the master speaker. The speaker to which audio signal is directly input from the audio equipment may be automatically selected as the master speaker or it may be selected manually by the user.

The control unit 13 of the speaker 1 that becomes the master speaker is set such that the reference clock is read from the built-in crystal oscillator in the clock switching unit 14. The direction control unit 12 of the master speaker operates at the reference clock supplied from this built-in crystal oscillator. Also, the control unit 13 instructs the clock switching unit 14 to send the reference clock to another speaker 1. The direction control unit 12 of the other speaker 1 operates based on the reference clock sent by this master speaker.

Moreover, digital audio data in the master speaker input to the direction control unit 12 from the conversion unit 16 is sent to the other speaker 1. The direction control unit 12 also reads the reference clock from the clock switching unit 14 mentioned above and operates, and supplies digital audio data to the other speaker 1. As a result, digital audio data synchronized in all the speakers 1 will be supplied. Audio signals from each audio equipment may be directly input to all the speakers 1, and subsequently, each direction control unit 12 may synchronize the audio data.

The control unit 13 of the master speaker sets the delay quantity of audio data supplied to each speaker unit 11 in the direction control unit 12. Additionally, the control units 13 of all linked speakers 1 are given instructions to set the delay quantity of audio data supplied to each speaker unit 11 in the direction control unit 12 of the speaker 1. Here, the master speaker takes the entire speaker unit as one speaker array and controls its directional characteristics.

That is, in FIG. 1, audio data is supplied at a specific delay quantity sequentially from speaker unit 11-1 of speaker 1A to speaker unit 11-8 of speaker 1B. At this stage, speaker 1C and speaker 1D are treated as being on the same line as speaker 1A and speaker 1B, and the delay quantity of each speaker is set. As a result, the directional characteristics of the entire array speaker system can be controlled.

The setting of delay quantity of all speakers to which the master speaker is connected was described in the example above, but the delay quantity may be set independently for each speaker. In this case, information specifying the beam direction between the speakers is to be exchanged so that audio beam is generated in the entire array speaker system.

As mentioned above, the array speaker system in the present embodiment synchronizes all the speakers after a plurality of speakers 1A to 1D are linked, and detects the coupling position. The apparent width of this array speaker system becomes twice the width, and the spacing of the speaker units becomes one-third; therefore, the frequency band at which direction control of this speaker unit becomes possible for a single speaker 1 is improved by two times on the low frequency side and by three times on the high frequency side.

An array speaker system linked with two stages in the left-right direction and three stages in the vertical direction was described in the present embodiment, but the present invention is not limited to this configuration only. Four stages or two stages may be linked in the vertical direction. The width of the speaker units may be offset and overlapped according to the number overlapped in the vertical direction. The number of speaker units linked varies according to the frequency band necessary for direction control; therefore, the cost of the speaker array is suppressed, and at the same time, the direction controllable frequency band can be easily enhanced.

Figure 8:
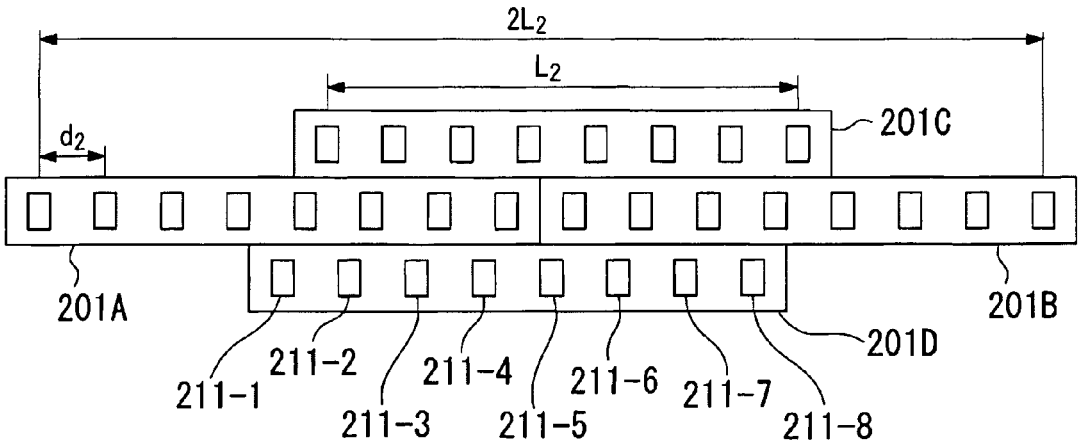
FIG. 8 is a conceptual diagram showing the configuration an array microphone system.

FIG. 8 is a schematic view showing the configuration of an array microphone system related to the embodiments of the present invention. As shown in this figure, the array microphone system is provided with a plurality of microphone devices 201A to 201D.

The microphone device 201A and the microphone device 201B are aligned and linked in the left-right direction. The microphone device 201C is linked to the upper part of the microphone device 201A and the microphone device 201B, while the microphone device 201D is linked to the lower part of the microphone device 201A and the microphone device 201B.

Each microphone device 201 is configured by 8 microphone units 211-1 to 211-8 disposed at equal intervals in a line at a spacing $d_2$, and is equivalent to the line array unit of the present invention. The microphone unit used is generally a dynamic microphone unit, but a different type such as a condenser microphone unit may also be used. The distance from the microphone unit 211-1 at one end to the microphone unit 211-8 at the other end is $L_2$. This distance $L_2$ is taken as the width $L_2$ of the microphone device 201. Here, in the array microphone system of the present embodiment, the microphone device 201A and the microphone device 201B are linked and aligned in a line in the left-right direction, so the apparent width of the array microphone system becomes 2 $L_2$.

In this example, a microphone device disposed with 8 microphone units is shown, but a larger number of microphone units may be disposed, or a smaller number may be disposed.

Moreover, the microphone device 201C is connected to the center and upper part of the microphone device 201A and the microphone device 201B such that the position in the horizontal direction of the microphone is offset by $d_2/3$ to the right. The microphone device 201D is connected to the center and lower part of the microphone device 201A and the microphone device 201B such that the position in horizontal direction of the microphone is offset by $d_2/3$ to the left.

Figure 9:
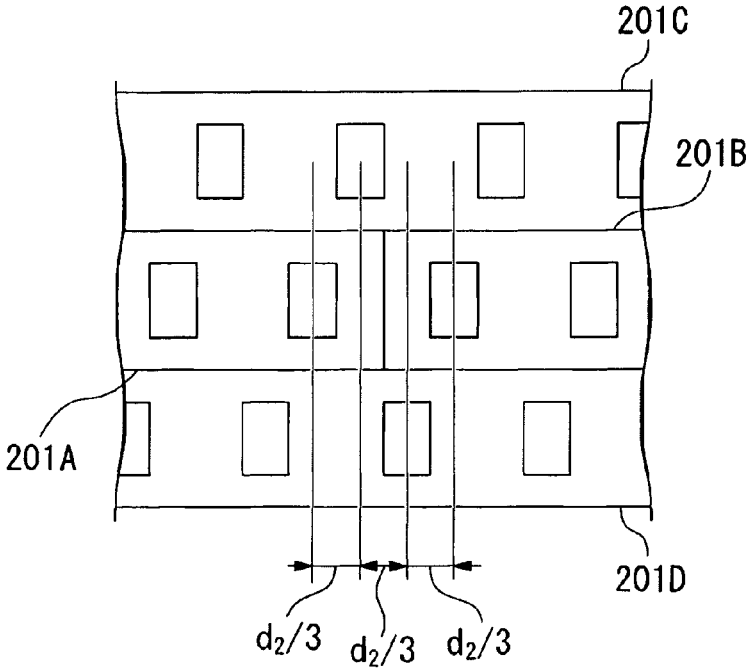
FIG. 9 is an explanatory diagram showing the overlap of the microphone devices.

FIG. 9 is an explanatory diagram showing the overlap of the microphone devices. As shown in this figure, the microphone device 201C overlaps the upper part of the microphone device 201A (and the microphone device 201B) and is offset by a distance of only $d_2/3$ to the right. Similarly, the microphone device 201D overlaps the lower part of the microphone device 201A (and the microphone device 201B) and is offset by a distance of only $d_2/3$ to the left. Accordingly, the apparent spacing of the microphone units of the array microphone system related to this overlapping location becomes the distance $d_2/3$.

Figure 10A:
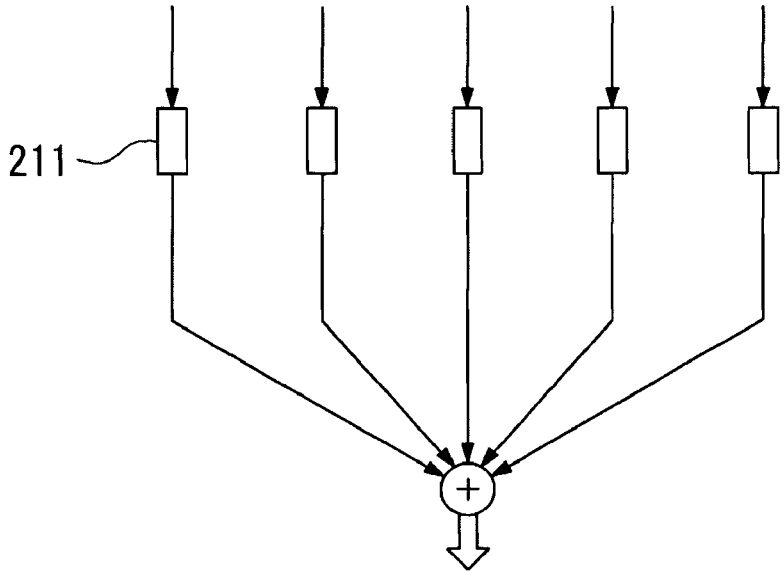
FIG. 10A is an explanatory diagram of the principle of an array microphone when sound waves at the same phase arrive at all the microphone units from the front side.
Figure 10B:
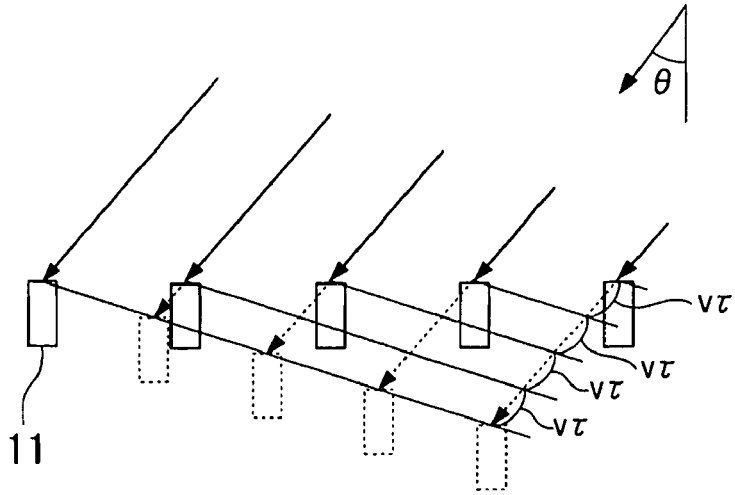
FIG. 10B is an explanatory diagram of the principle of an array microphone and shows the main beam when it is inclined.

FIG. 10A and FIG. 10B are diagrams that explain the principle of the array microphone. The principle of the array microphone is described here.

FIG. 10A shows the case when the sound waves at the same phase arrive from the front of all the microphone units 211. When the sound waves at the same phase arrive at all the microphone units 211, the audio signal output from individual microphone units 211 are reinforced by synthesis. On the other hand, when sound waves arrive from any other direction, the audio signals output from each microphone unit 211 differ in phase and are weakened when synthesized. Accordingly, the sensitivity of the array microphone is reduced in beam form, and the main sensitivity (main beam) is formed only in the front direction.

FIG. 10B shows the main beam being inclined. The main beam in FIG. 10B is formed at an angle of θ to the right of the frontal view. In this case, the audio wave arrives from the end (right end) in the direction of the main beam, and finally the audio wave arrives at the end (left end) opposite to the direction of the main beam. Therefore, audio signal is to be output from the next adjacent microphone unit 211 to the right after each time interval r from the microphone unit 211 on the left side. This delay time is controlled by the direction control unit (described later) connected to each microphone unit 211.

In this way, by sequentially delaying the audio signals output from microphone units 211 aligned in a row from one end to the other end, the main beam is inclined as shown in the figure, according to the delay time.

This angle of inclination θ, assuming the velocity of sound as v, is given by the relationship $\sin\theta = v\tau/d_2$. Accordingly, the angle θ of the main beam can be controlled by controlling τ.

FIG. 11A to FIG. 11D are figures that show examples of control angle of the main beam.

In the graph shown in FIG. 11, the horizontal axis expresses θ, while the vertical axis represents the gain of the array microphone (taken as G). FIG. 11A shows the relationship between angle θ and gain G, taking an example wherein the number of microphone units n=16, spacing of microphone units $d_2$=4.5 cm, and width of array microphone $L_2$=67.5 cm.

Figure 11A:
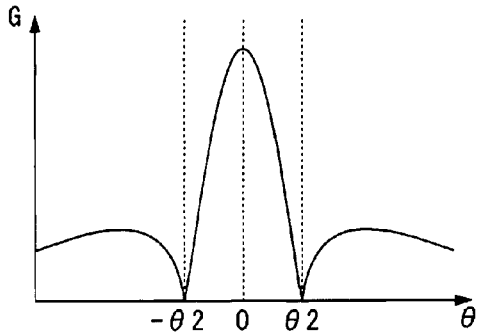
FIG. 11A illustrates an example of the audio beam control angle, and shows the relationship between the angle θ and gain G.

In FIG. 11A, the gain G becomes maximum at θ=0 when the target main beam direction is taken as θ=0. As the angle increases away from θ=0, the audio signals output from each microphone unit cancel out, and the gain decreases and becomes zero at θ=±θ2. The width until the gain G becomes zero across the target main beam direction θ=0 is taken as the beam width. The θ2 at which this gain G becomes zero, that is, the main beam width from the formula 3 above taking the frequency as f is determined as $\theta 2 = \sin^{-1}(v/fd_2n)$.

FIG. 11A shows an example related to frequency f=1 kHz. In this embodiment, each microphone unit is disposed at equal distance of spacing $d_2$, so the width $L_2$ of the array microphone is expressed as $L_2 = d_2(n-1)$; the beam width θ2 is expressed in terms of spacing $d_2$ of the microphone units, the width $L_2$ of the array microphone, and the frequency f, from formula 3.

Figure 11B:
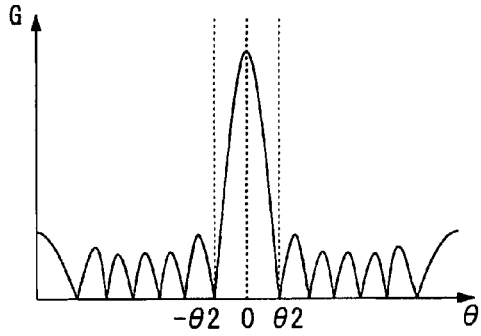
FIG. 11B shows an example of the audio beam control angle when the number of microphone units is taken as four times with the conditions of FIG. 11A.

FIG. 11B shows the relationship between angle θ and gain G when the number of microphone units n is taken as n=64 (four times). The horizontal axis represents θ and the vertical axis represents gain in the graph shown in FIG. 11B also. The beam width in FIG. 11B is smaller than the beam width shown in FIG. 11A, and has sharp directional characteristics in the target direction. From the relationship $\sin\theta 2 = v/fd_2n$, even if the frequency is taken as four times, or the width $d_2$ of the microphone unit is taken as four times, the beam width as shown in FIG. 11B can be obtained.

Figure 11C:
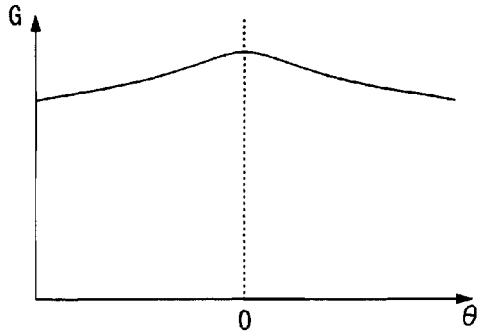
FIG. 11C shows an example of the audio beam control angle when the frequency is one-fourth the frequency with the conditions of FIG. 11A.

FIG. 11C shows the relationship between the angle θ and gain G when one fourth the frequency f is taken, that is, when f=250 Hz in the conditions in FIG. 11A. Even in the graph shown in FIG. 11C, the horizontal axis represents θ and the vertical axis represents gain. In FIG. 11C, θ2 at which the gain G becomes zero, does not exist.

Figure 11D:
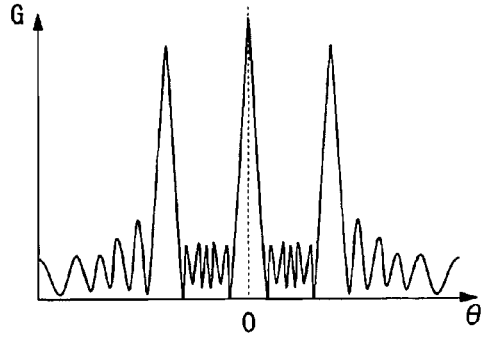
FIG. 11D shows an example of the audio beam control angle when the frequency is eight times the frequency with the conditions of FIG. 11A.

FIG. 11D shows the relationship between the angle θ and gain G when 8 times the frequency f is taken, that is, when f=8 kHz in the conditions in FIG. 11A. Even in the graph shown in FIG. 11D, the horizontal axis represents θ and the vertical axis represents gain. The main beam is generated even in directions other than θ=0 in FIG. 11D. This is the so-called spatial alias; as shown in FIG. 11D, the phenomenon occurs at a frequency at which $d_2 \geqq v/2f$.

In this way, the width of the main beam in the array microphone is frequency dependent. As in the example above, when the number of microphone units n=16, the spacing of the microphone units $d_2$=4.5 cm, and the width of the array microphone $L_2$=67.5 cm, the frequency band at which direction is controllable becomes 500 Hz approximately to 4 kHz approximately. At frequencies lower than this frequency band, the directional characteristics do not exist as shown in FIG. 11C; at high frequencies, the main beam is generated even in directions other than the target direction, as shown in FIG. 11D.

As mentioned above, the angle θ2 at which the gain becomes zero can be expressed by $\sin \theta 2 = v/fd_2n$; thus, the effect of the frequency f, the width $d_2$ of the microphone unit, and the number of microphone units n on θ2 is equivalent. That is, by reducing the spacing $d_2$ of the microphone units, by further increasing the number of microphone units n, and by increasing the width $L_2$ of the array microphone, the direction controllable frequency bandwidth can be expanded.

Here, the array microphone system of the present embodiment includes the microphone device 201A and the microphone device 201B aligned and linked in the left-right direction; thus, the apparent number of microphone units of this array microphone system is two times the number. That is, the width $L_2$ of the array microphone becomes twice the width, and the frequency band at which direction can be controlled expands to two times on the low frequency side. Moreover, the microphone device 201C and the microphone device 201D are overlapped and offset above and below by only d/3 in the left-right direction; thus, the apparent spacing of the microphone unit of this array microphone system becomes $d_2/3$, and the frequency band at which direction can be controlled expands to three times on the high frequency side.

Consequently, by reducing the number of microphone units, designing a single microphone device with suppressed cost, linking a plurality of microphone devices as necessary according to the frequency band as in the example above, the direction controllable frequency band can be easily enhanced in the array microphone system of the present invention.

Next, the configuration of each microphone device of the array microphone system of the present embodiment is described in detail.

Figure 12:
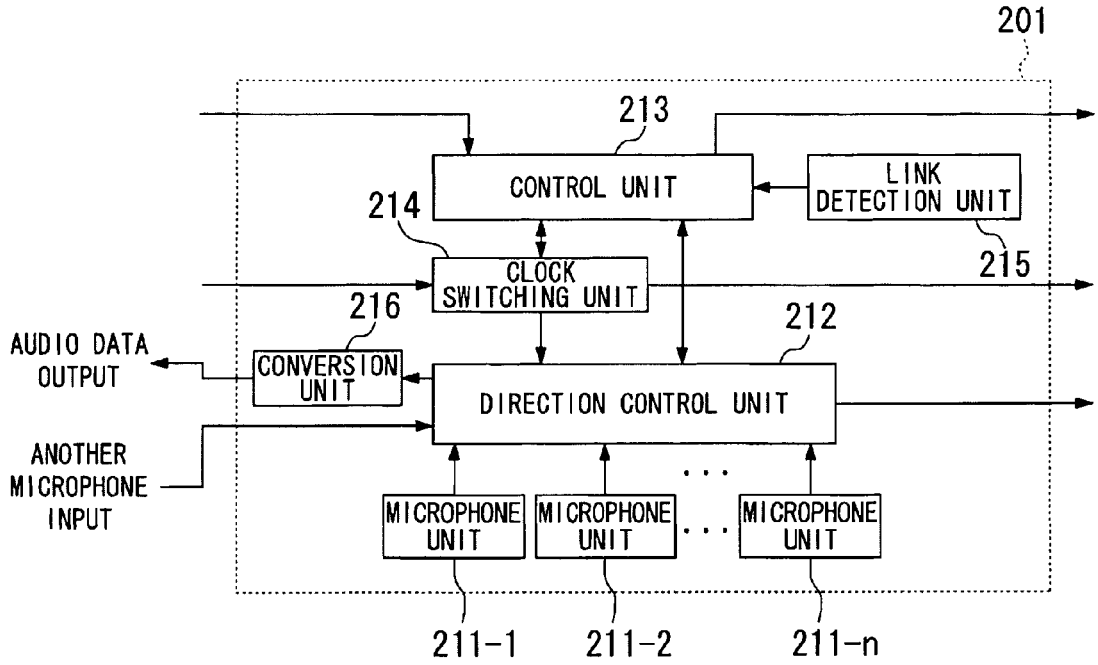
FIG. 12 is a block diagram showing the configuration of a microphone device.

FIG. 12 is a block diagram showing the configuration of each microphone device. As shown in this figure, the microphone device 201 is provided with n microphone units 211-1 to **211-*n*, a direction control unit 212, a control unit 213, a clock switching unit 214, a link detection unit 215 and a conversion unit 216**.

The n microphone units 211-1 to **211-*n* are connected to the direction control unit 212. Each unit performs A/D conversion of the picked-up audio signal, and supplies it to the direction control unit 212. The direction control unit 212 is connected to the control unit 213, the clock switching unit 214, and the conversion unit 216. The link detection unit 215 is also connected to the control unit 213**.

The direction control unit 212, the control unit 213 and the clock switching unit 214 are each connected to a direction control unit 212, a control unit 213 and a clock switching unit 214 of another microphone device 201. The direction control unit 212, the control unit 213, and the clock switching unit 214 may share a single connection wire (connection terminal) with the other microphone device 201, or each may be connected by a separate connection wire (connection terminal).

The direction control unit 212 outputs each audio signal output from the microphone unit 211-1 to **211-*n* with a specific delay quantity and controls the directivity of the array microphone. Each delay quantity is set by the control unit 213. The output signal of the direction control unit 212 is output to the conversion unit 216** and another microphone device at a specific delay quantity as audio data (audio signal).

The control unit 213 controls the clock switching unit 214 and the direction control unit 212, sends control commands to the control unit 213 of the other connected microphone device 201 and controls the other control unit 213.

The clock switching unit 214 is connected to the crystal oscillator (not illustrated) built-in in the microphone device, and supplies the reference clock to the direction control unit 212. The direction control unit 212 operates based on this reference clock. Moreover, when the clock switching unit 214 is connected to the clock switching unit 214 of another microphone device 201, it sends the reference clock to the clock switching unit 214 of the other microphone device 201. When the reference clock is received from the other microphone device 201, either the reference clock received by the direction control unit 212, or the reference clock of the built-in crystal oscillator is selectively supplied.

The conversion unit 216 is provided with the D/A conversion function for converting the audio data input from the direction control unit 212 to analog audio signal. The converted analog audio signal is output externally to audio equipment (recording equipment) and the like. The conversion unit 216 is also provided with a frequency conversion function that converts the reference sampling frequency (for example 48 kHz) of the microphone device 201 to the sampling frequency (for example, 44.1 kHz) of CD, and so on, and can also output it as digital audio signal to audio equipment and the like.

Figure 13:
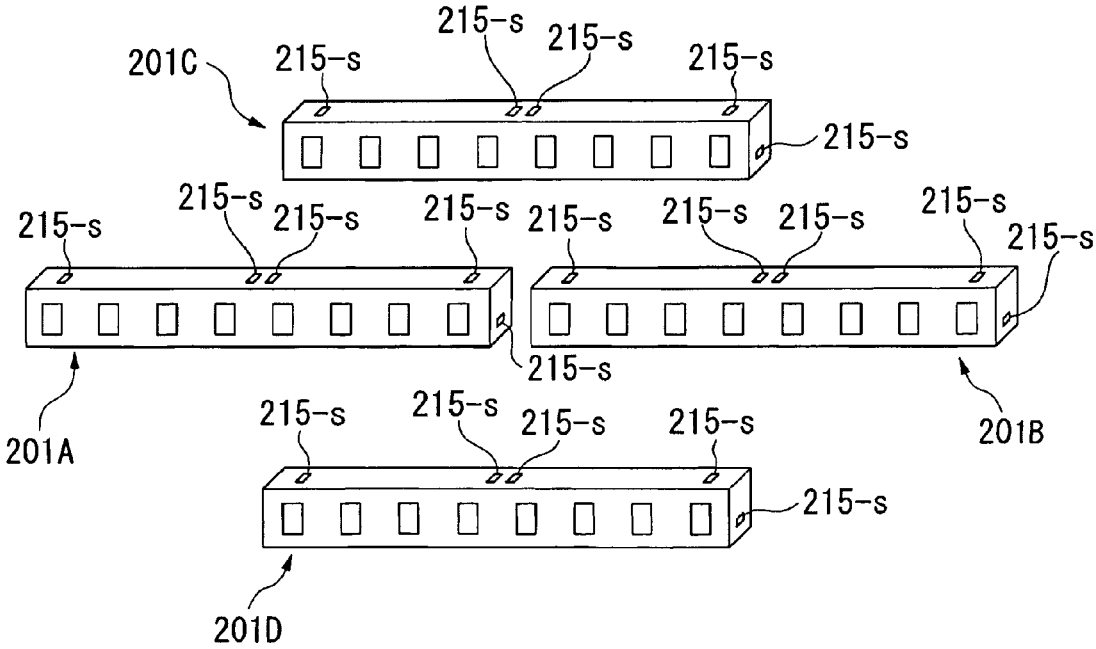
FIG. 13 is a conceptual diagram showing the linking connectors.
Figure 14:
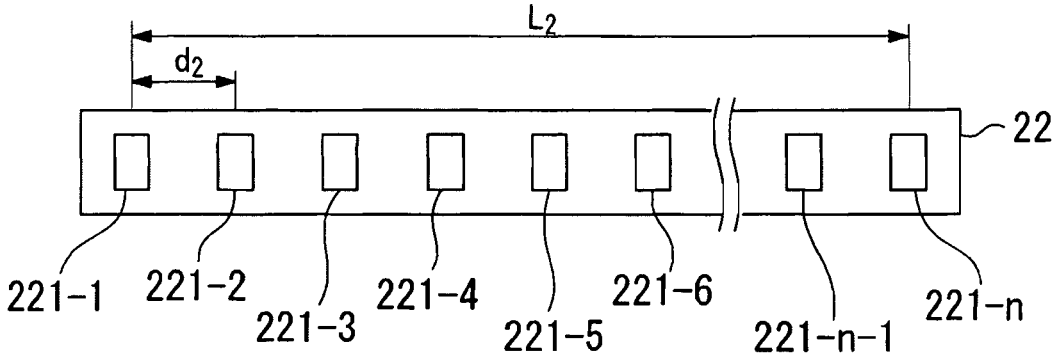
FIG. 14 is a block diagram showing the conventional line array microphone unit.

FIG. 13 shows the link detection unit 215 composed of a plurality of linking connectors **215-*s* installed around the microphone device 201. The link detection unit 215 detects the connected condition of each microphone device 201, and sends the position within the array microphone system where its own microphone device 201 is connected to the control unit 213. Each microphone device 201 is installed with linking connectors 215-*s* on the right side face, left side face, right upper face, right central upper face, left central upper face, left upper face, right lower face, right central lower face, left central lower face, and left lower face respectively. The connected position to be detected according to which linking connector 215-*s* is connected to the linking connector 215-*s* of the other microphone device 201**.

For example in FIG. 13, the microphone device 201A is connected by its right side face connector, right upper face connector, right central upper face connector, right lower face connector, and the right central lower face connector. In this disposition of connections, the link detection unit 215 judges the microphone device 201 to be positioned on the left side of the center stage in the array microphone system. As a result, the linked position within the array microphone system can be detected.

As mentioned above, these linking connectors 215-*s* are installed at linking positions where the microphone unit 211 is displaced by $d_2/3$ in the vertical direction. The above-mentioned direction control unit 212, control unit 213, and the clock switching unit 214 are connected to another direction control unit 212, control unit 213 and clock switching unit 214 by the linking connector 215-*s*.

The method of detecting the linking position is not limited to the present example. For instance, the position of the microphone device 201 may be specified by user's manual operation.

Next, the direction control of this array microphone system is described in detail. When the user connects any of the microphone devices 201 to audio equipment, this microphone device 201 becomes the master microphone device of the array microphone system. This master microphone device controls another microphone device 201 linked to it. The microphone device 201 directly connected to audio equipment may be treated as the master microphone device, or another microphone device 201 may be treated as the master microphone device. The microphone device directly connected to audio equipment may be automatically selected as the master microphone device, or it may be selected by the user manually.

The control unit 213 of the microphone device 201 that becomes the master microphone device is set such that the reference clock is read from the built-in crystal oscillator in the clock switching unit 214. The direction control unit 212 of the master microphone device operates at the reference clock supplied from this built-in crystal oscillator. Moreover, the control unit 213 instructs the clock switching unit 214 to send the reference clock to the other microphone device 201. The direction control unit 212 of the other microphone device 201 operates based on the reference clock sent by the master microphone device.

Moreover, the audio data output by each microphone unit 211 to the direction control unit 212 in the other microphone device is input to the direction control unit 212 of the master microphone device. The direction control unit 212 in the other microphone device reads the reference clock sent by the master microphone device and operates, and supplies the audio data to the master microphone device. As a result, synchronized audio data from all the microphone devices 201 will be supplied to the master microphone device. The audio data input to the direction control unit 212 of the master microphone device 201 is output to the directly-connected audio equipment.

Audio equipment may connected to each of the microphone devices 201, and audio data may be output to the audio equipment from each of the microphone devices 201.

The control unit 213 of the master microphone device sets the delay quantity of audio data output by each microphone unit 211 to the direction control unit 212. Instructions are given to the control unit 213 of all the linked microphone devices 201 to set the delay quantity of audio data output by each microphone unit 211 to the direction control unit 212 of each microphone device 201. Here, the master microphone device controls the directional characteristics of all the microphone units as one array microphone. That is, in FIG. 8, the audio data is output at the specific delay quantity sequentially from microphone unit 211-1 of the microphone device 201A to the microphone unit 211-8 of the microphone device 201B.

At this stage, the microphone device 201C and the microphone device 201D are treated as existing on the same line as the microphone device 201A and the microphone device 201B, and the delay quantity of each is set. As a result, the directional characteristics of the entire array microphone system can be controlled.

In the example above, setting the delay quantity of all the microphone devices linked to the master microphone device was described; however, the delay quantity of each microphone device may be set independently. In this case, it is assumed that the data specifying the beam direction is exchanged between the microphone devices such that the main beam is formed in the entire array microphone system.

As described above, the array microphone system in the present embodiment links a plurality of microphone devices 201A to 201D, synchronizes all the microphone devices, and detects the linked position. The apparent width of this array microphone system becomes twice the width and the spacing becomes one-third the spacing. Thus, the frequency band at which this microphone unit can be controlled is enhanced and becomes twice on the low frequency side, and becomes thrice on the high frequency side compared to the single microphone device 201.

An array microphone system linked with two stages in the left-right direction and three stages in the vertical direction was described in the present embodiment, but the present invention is not limited to this configuration only. Four stages or two stages may be linked in the vertical direction. The width of the microphone unit may be offset and overlapped according to the number overlapped in the vertical direction. The number of microphone units that are linked varies according to the frequency band necessary for direction control; so an array microphone with suppressed cost and direction controllable frequency band can be easily enhanced.

INDUSTRIAL APPLICABILITY

The present invention can be used in applications where the direction of frequency band needs to be controlled such as in sound systems necessary for screen projection of movies, and in applications where direction of the frequency band needs to be controlled such as in pick up apparatus for picking up the voice of a narrator.

The invention claimed is:

1. An array speaker system comprising a plurality of line array units each including a plurality of speaker units aligned on a straight line at equal intervals with a spacing between the speaker units in a longitudinal direction of the line array unit, the line array units being linked in a lateral direction perpendicular to the longitudinal direction, the line array units being offset in the longitudinal direction by "the spacing/the number of the line array units linked in the lateral direction", each of the line array units further comprising:

a case in which the plurality of speaker units are disposed, the case having longitudinal side faces in the longitudinal direction and lateral side faces in the lateral direction;

a plurality of linking connectors, at least one linking connector being disposed on each of the lateral side faces and at least two linking connectors being disposed on each of the longitudinal side faces;

an input device for inputting audio signals;

a signal processing device for supplying the audio signals by delaying them at specific delay times to each speaker unit and for controlling a directivity of the line array unit;

a link detection device for detecting a linked direction and a linked position of the line array unit within the array speaker system based on a connection state of the plurality of linking connectors; and a control device for setting delay times of the signal processing device according to the linked direction and the linked position detected by the link detection device.

2. The array speaker system according to claim 1, wherein a first one of the plurality of line array units is linked to another line array unit in the longitudinal direction to form a two line array unit arrangement, and a second one of the plurality of line array units linked to the first one of the plurality of line array units is linked at the center of the two line array unit arrangement in the lateral direction.

3. An array microphone system comprising a plurality of line array units each including a plurality of microphone units disposed side by side on a straight line at equal intervals with a spacing between the microphone units in a longitudinal direction of the line array unit, the plurality of line array units being linked in a lateral direction perpendicular to the longitudinal direction, the line array units being offset in the longitudinal direction by "the spacing/the number of the line array units linked in the lateral direction", each of the line array units further comprising:

a case in which the plurality of microphone units are disposed, the case having longitudinal side faces in the longitudinal direction and lateral side faces in the lateral direction;

a plurality of linking connectors, at least one linking connector being disposed on each of the lateral side faces and at least two linking connectors being disposed on each of the longitudinal side faces;

a signal processing device for delaying the delay time of audio signals output by each microphone unit and for controlling a directivity of line array units in each microphone unit;

an output device for outputting audio signals externally;

a link detection device for detecting a linked direction and a linked position of the line array unit within the array microphone system based on a connection state of the linking connectors; and a control device for setting delay times of the signal processing device according to the linked direction and the linked position detected by the link detection device.

4. The array microphone system according to claim 3, wherein a first one of the plurality of line array units is linked to another line array unit in the longitudinal direction to form a two line array unit arrangement, and a second one of the plurality of line array units linked to the first one of the plurality of line array units is linked at the center of the two line array unit arrangement in the lateral direction.

* * * * *